US005157242A

United States Patent [19]

Hetherington et al.

[11] Patent Number: 5,157,242

[45] Date of Patent: Oct. 20, 1992

[54] HANGING HEATING ELEMENT FOR HIGH TEMPERATURE FURNACE

[75] Inventors: James S. Hetherington, Santa Barbara; Mark D. Mahone, Goleta, both of Calif.

[73] Assignee: Hetherington, Inc., Ventura, Calif.

[21] Appl. No.: 604,497

[22] Filed: Oct. 29, 1990

[51] Int. Cl.[5] ..... H05B 3/62

[52] U.S. Cl. ..... 219/539; 219/548; 338/325; 338/295; 373/117; 373/134

[58] Field of Search ..... 219/517, 539, 548, 552, 219/553; 338/295, 294, 325; 373/117, 134

[56] References Cited

U.S. PATENT DOCUMENTS

| | | | |
|---|---|---|---|
| 2,650,254 | 8/1953 | Kremers | 373/110 |
| 2,938,992 | 5/1960 | Crump | 219/528 |
| 2,971,039 | 2/1961 | Westeren | 373/110 |
| 3,020,378 | 2/1962 | Eisler | 219/542 |
| 3,088,019 | 4/1963 | Crump | 219/528 |
| 3,178,665 | 4/1965 | Matheson et al. | 338/299 |
| 3,274,374 | 9/1966 | Matheson et al. | 219/552 |
| 3,283,284 | 11/1966 | Eisler | 219/528 |
| 3,300,746 | 1/1967 | Franz | 338/55 |
| 4,410,796 | 10/1983 | Wilsey | 219/553 |

*Primary Examiner*—Bruce A. Reynolds
*Assistant Examiner*—Michael D. Switzer
*Attorney, Agent, or Firm*—Marvin E. Jacobs

[57] ABSTRACT

Six curved hanging electrical heater panels made of tungsten or molybdenum are arranged to form a hollow cylinder, and are supported at their upper ends by electrical connectors. The hanging panels are electrically interconnected at adjacent lower corners by removable links. Six phase electrical current is applied to the hanging panels through the respective upper connectors, with phases of opposite polarities being applied to diametrically opposed panels. The net current flow through the removable links is zero, enabling the links to be designed to fail electrically and/or mechanically before the panels, thereby protecting the panels from electrical burnout and mechanical damage. Each removable link includes a unique arrangement of a link member, two pins, and a wedge which tightly interlocks the pins, link member and panel corners together.

10 Claims, 4 Drawing Sheets

HANGING HEATING ELEMENT FOR HIGH TEMPERATURE FURNACE

TECHNICAL FIELD

The present invention generally relates to high temperature furnaces, and more specifically to a hanging heating element for a high temperature furnace including removable links which electrically interconnect individual panels of the heating element to facilitate installation and maintenance thereof.

BACKGROUND OF THE INVENTION

Early electrical heating elements for high temperature furnaces operating in a temperature range of 2500° C. to 3000° C. include donut shaped heating elements which consume inordininately large amounts of electric urrent and produce uneven and inefficient heating. A major improvement to high temperature furnaces was the cylindrical hanging heating element which was invented by Charles Hill in 1960. The hanging heating element includes a number of hanging panels, such as three, which are made of tungsten or molybdenum and are supported at their upper ends by rods or bars which also function as connectors for applying electric current to the panels. The lower ends of the panels are interconnected by a thick metal ring which serves as a common electrical connector and is able to expand and contract freely during furnace operation with no mechanical constraints. The metal ring has conventionally been made thick and heavy to handle the large alternating current, on the order of 2000 amperes, which flows through the panels and ring.

The panels may be in the form of thin sheets, or may be formed of a mesh as disclosed in U.S. Pat. No. 3,469,013, to James S. Hetherington et al.

There has been little improvement in hanging heating elements since 1967 due to static business conditions with unchanging requirements. However, hanging heating elements have become quite large in recent years, posing new problems.

The larger heating panels are made of molybdenum or tungsten in the form or 10 to 15 mil thick sheets. Although the sheets are originally quite ductile, they recrystallize after a short period of operation in excess of 1200° C., becoming extremely brittle and fragile. In addition, the metal at the re-entrant angle where the panels join the ring becomes embrittled due to welding and riveting operations performed during the fabrication process.

Installation of conventional hanging heating elements is difficult and hazardous since six heavy, fragile panels which are connected only at their lower ends must be simultaneously manipulated into position. The heating chamber is usually at high location such as 6 feet above floor level and it is difficult to manipulate and align the element within the insulation lined housing. Movement of any one of the panels away from the center can create a micro-crack at the re-entrant angle which propagates through the panel, ending its life prematurely. With the panels permanently connected to the lower ring, damage to one panel requires replacement of the entire heating element, which is very expensive and time consuming. Similarly, failure of one panel during operation requires replacement of the entire element.

STATEMENT OF THE INVENTION

The present invention improves over known hanging furnace heating elements in two areas. First, the present heating element is provided with six panels, which are connected to six respective phases of electrical current such that diametrically opposed panels are connected to phases of opposite polarity. It has been determined by the present inventors that the net current flow through the interconnected lower corners of the panels is zero. This makes it possible to replace the thick ring found in conventional hanging heating elements with relatively small removable links, since the high electrical current carrying requirement has been eliminated. The links can be made weaker than the panels both mechanically and electrically, thereby protecting the panels from damage during installation and operation.

Secondly, the removable links enable the heating element to be installed one panel at a time, rather than as an integral unit as in the prior art. This greatly reduces the possibility of damage, and enables a single panel which does become damaged during installation to be replaced individually rather than requiring replacement of the entire heating element. The removable links further enable panels which burn out or become damaged during operation of the heating element to be replaced individually, resulting in great savings of time and expense.

These and many other features and attendant advantages of the invention will become apparent as the invention becomes better understood by references to the following detailed description when considered in conjunction with the accompanying drawings.

DETAILED DESCRIPTION OF THE INVENTION

Figure 1:
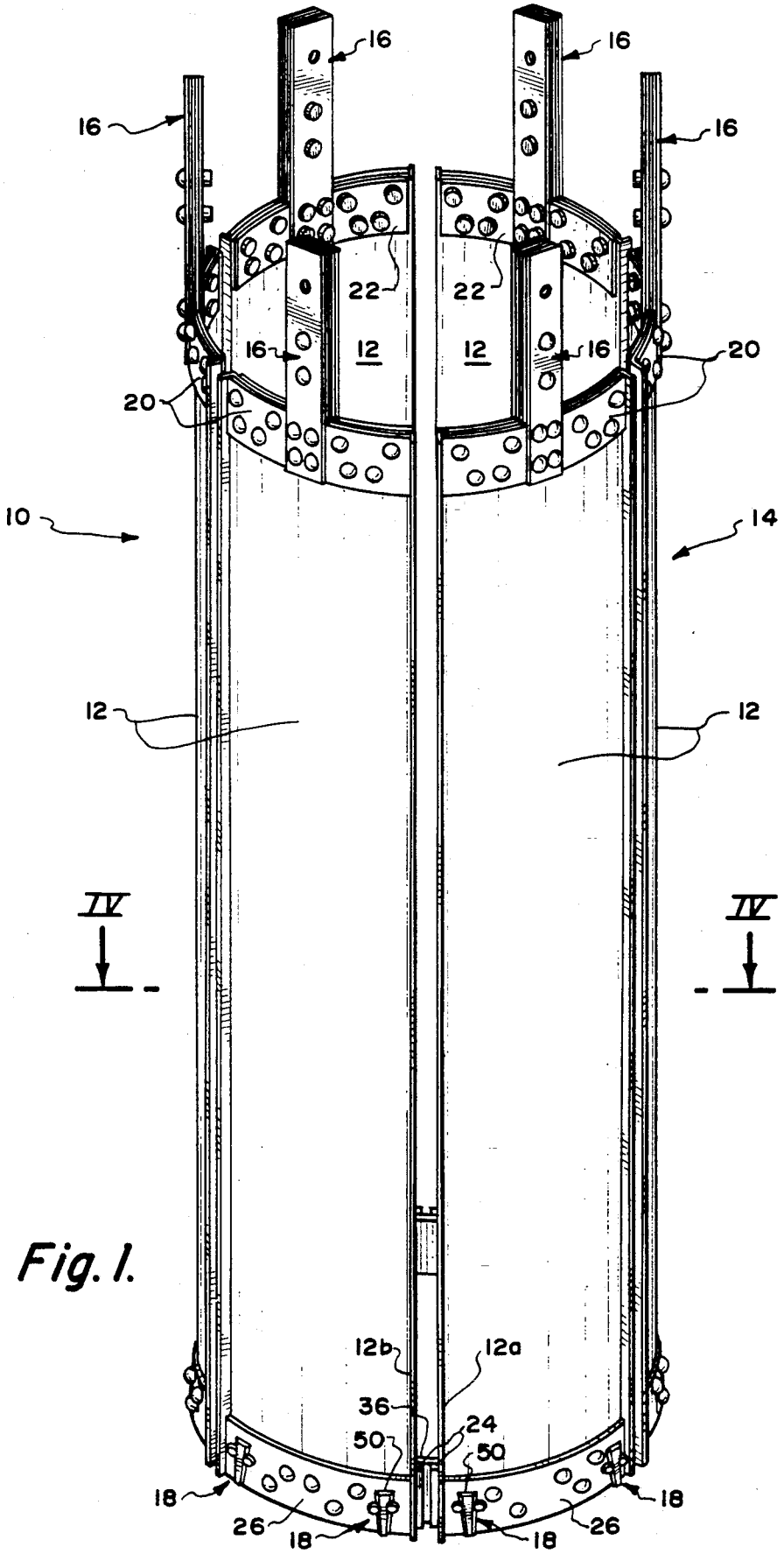
FIG. 1 is a perspective view of a hanging furnace heating element according to the present invention.

Referring now to FIG. 1 of the drawing, a hanging heating element for a high temperature furnace is generally designated by the reference numeral 10 and includes six identical hanging heater panels 12. The panels 12 may be formed of 10 to 15 mil thick sheets of molybdenum or tungsten, or a mesh of these or other appropriate electrical heating materials. The panels 12 may further be formed with a pattern of perforations designed to control heat distribution in the furnace hot zone, although not shown.

The panels 12 are arranged to form a vertically extending hollow cylinder 14, and are curved about the central vertical axis to conform to the radius of the cylinder. Each panel 12 is supported by an electrical connector 16 at an upper end thereof which may be in the form or a bar or rod. A lower left corner portion 12*a* of each panel 12 is mechanically and electrically connected to a lower right corner portion 12b of the adjacent panel 12 by a removable link assembly 18.

Figure 3:
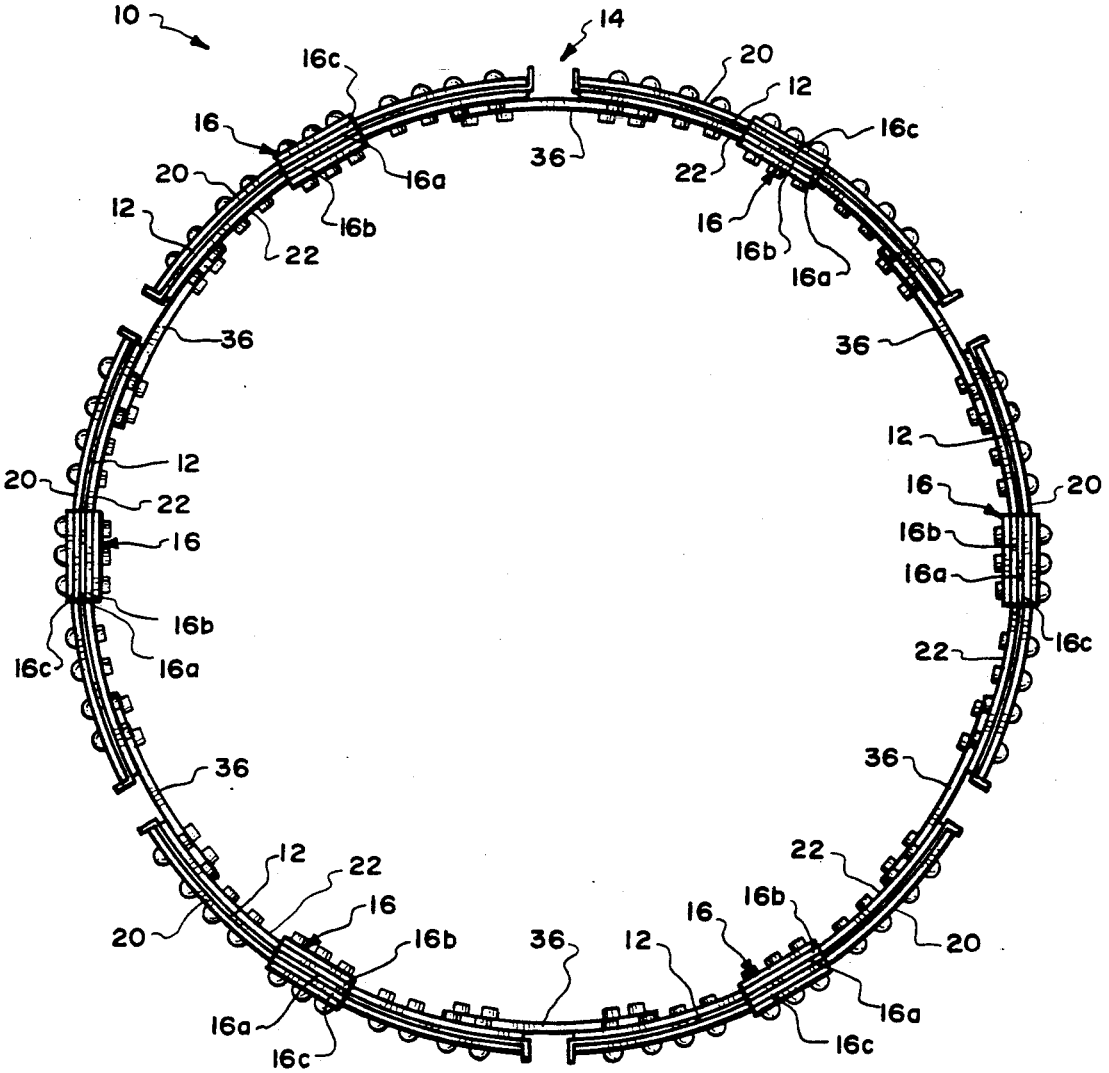
FIG. 3 is a top view of the heating element.

As viewed in FIG. 3, the thin panels 12 are mechanically reinforced at their upper edges by inner and outer curved metal band segments 20 and 22 respectively. The electrical connectors 16 include a central high current heater bar 16a made of tungsten which extends upwardly from the top edge of the panel 12, and inner and outer reinforcing bars 16b and 16c which may similarly be made of tungsten, or may be made of another electrically conductive refractory metal. The bars 16b and 16c sandwich the bar 16a therebetween with the bar 16a providing electrical connection between the panel 12 and a power source which will be described below. The panel 12, bands 20 and 22, and bars 16a to 16c are connected together means such as rivets, which are illustrated but not designated by reference numerals, welding, or other applicable fastening means or combinations thereof.

Figure 4:
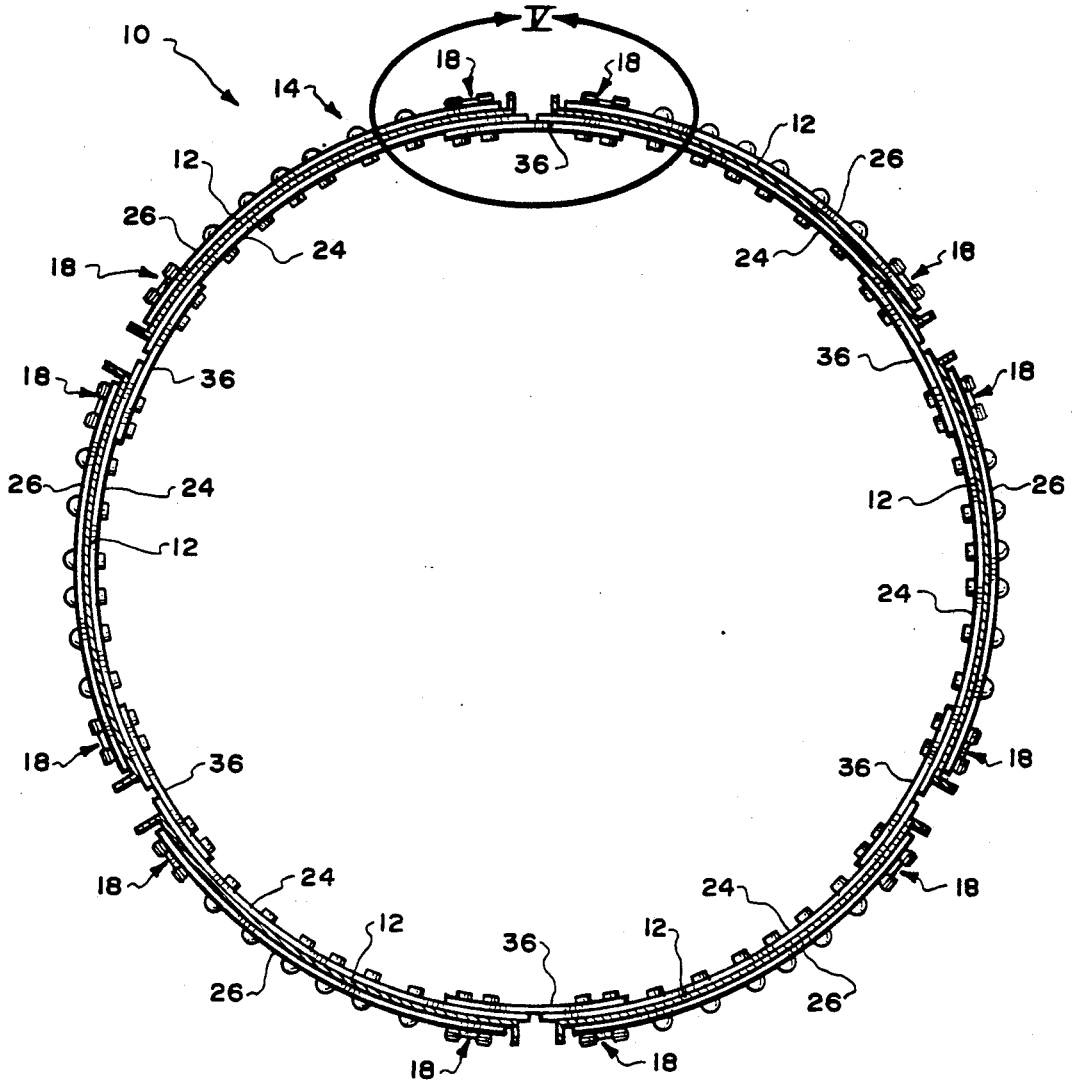
FIG. 4 is horizontal section taken through a line IV—IV of FIG. 1.

Curved inner and outer metal band segments 24 and 26 respectively are provided for mechanically reinforcing the thin panels 12 at their bottom edges, as illustrated in FIG. 4.

Figure 2:
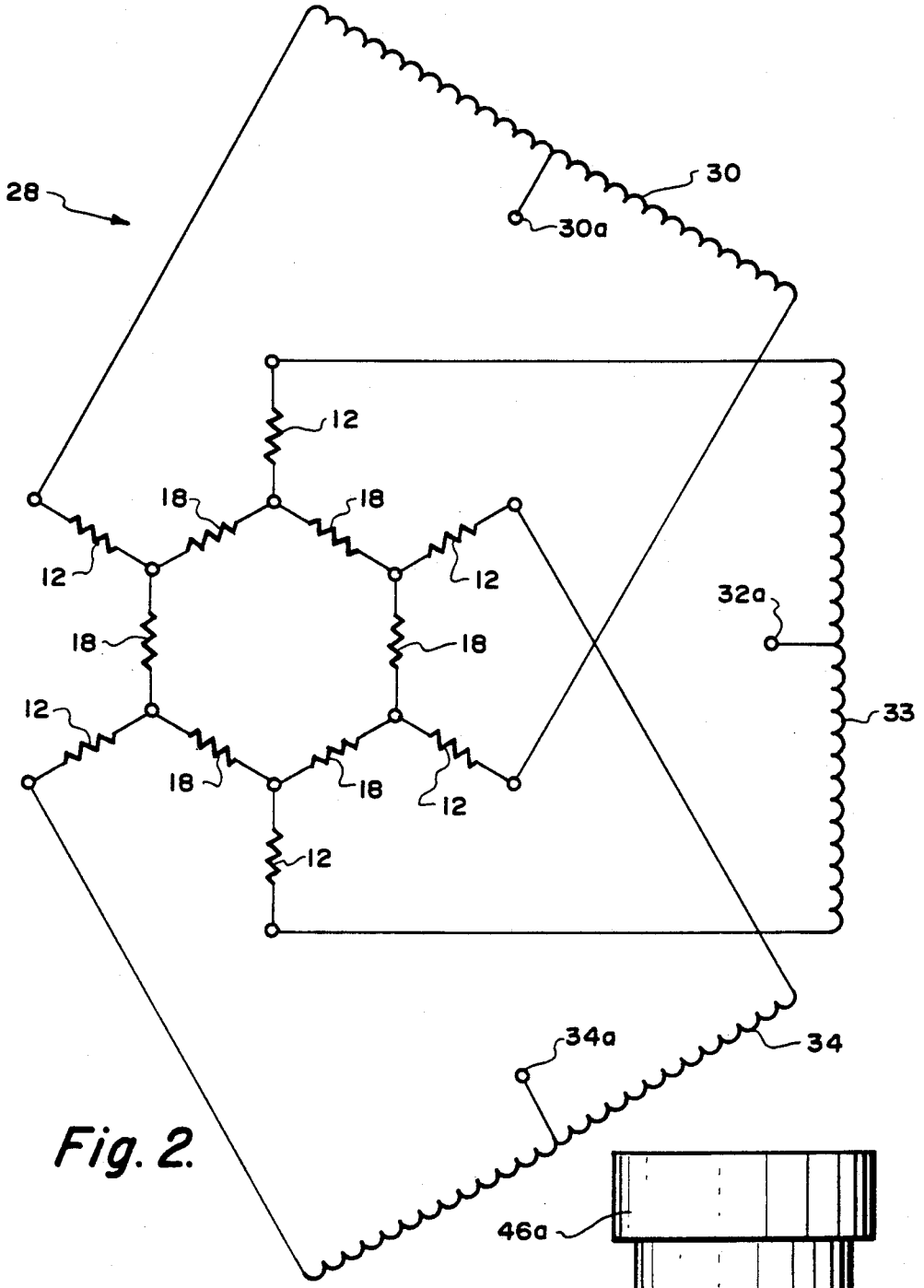
FIG. 2 is an electrical wiring diagram of the present heating element.

In accordance with an important feature of the present invention as illustrated in FIG. 2, an electrical six phase alternating current power source is designated as 28, and includes three center-tapped output windings 30, 33 and 34. Each winding 30, 33 and 34 produces an output voltage which is phase shifted by 120° relative to another of the windings, and has a center tap 30a, 32a, and 34a respectively. The output phase between one end of the winding 30 and the center tap 30a thereof has a polarity opposite to the output phase between the other end of the winding 30 and the center tap 30a. The same is true for the windings 32 and 34.

The opposite ends of each winding 30, 33 and 34 are connected to the electrical connectors 16 of diametrically opposed panels 12 respectively as arranged in the cylinder 14. This configuration resembles a six pointed star as viewed in FIG. 2, which further illustrates the link assemblies 18 interconnecting the lower corners of the panels 12. It has been determined mathematically by the present inventors, and verified by empirical measurements, that the net current flow through each of the link assemblies 18 in the "Star-Six" arrangement of FIG. 2, is zero. The center taps 30a, 32a and 34a are interconnected, although not shown in the drawing, and may be grounded, or preferably allowed to float above ground.

The zero net current flow through the link assemblies 18 which interconnect the panels 12 enables the assemblies 18 to be made small and light, compared to the large metal rings which are welded to the bottoms of conventional heating panels. Preferably, the link assemblies 18 are further designed to be fusible at a value of electrical current below a value at which damage to the panels 12 would occur. Although the current through the assemblies 18 is zero during normal operation of the heating element 10, damage or burnout of one of the panels 12 will cause an abnormally large current to flow through at least one of the other panels 12. This condition would also create an imbalance in the Star-Six connection, resulting in a non-zero current flow of large magnitude through one or more of the link assemblies 18. Design of the link assemblies 18 to fuse or burn out at a relatively low value of current will open the circuit to the respective panels 12, preventing large current flow and damage thereto.

In addition to designing the link assemblies 18 to function as electrical fuses, it is desirable to make the link assemblies 18 mechanically weak enough to break before the panels 12 in response to relative movement between the panels 12. Such movement toward or away from the center of the cylinder 14 might occur during initial installation of the heating element 10 or replacement of a single damaged panel 12. Movement of the upper end of one of the relatively large panels 12 results in a large torsional moment being applied to the link assemblies 18 at the bottom end of the panel 12 due to the large lever arm constituted by the panel 12. The link assemblies 18 are therefore preferably designed to have a shear strength which is low enough to cause the link assemblies 18 to break in response to movement of the respective panel 12 which is insufficient to cause damage to the panel 12, even with the molybdenum or tungsten material of the panel 12 in a recrystallized state after a prolonged period of furnace operation. Thus, in accordance with the present invention, the link assemblies 18 protect the expensive hanging panels 12 from being damaged electrically or mechanically.

Figure 5:
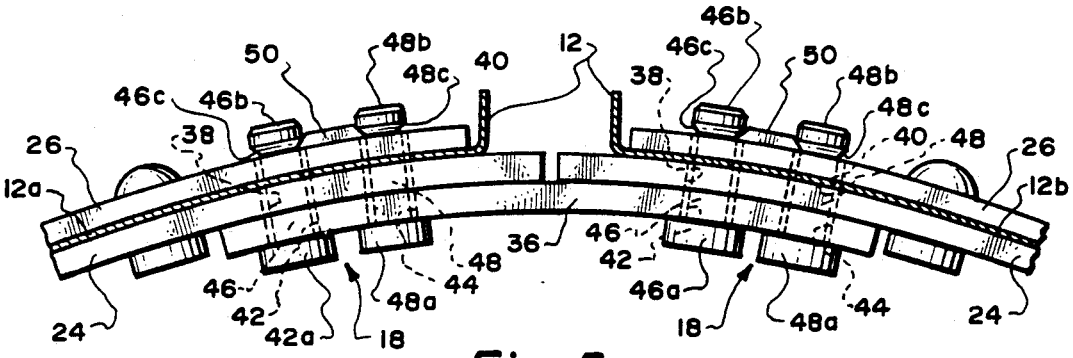
FIG. 5 is a fragmentary section taken through a line V—V of FIG. 4 illustrating a removable link assembly of the present heating element.

As illustrated in FIG. 5, each link assembly 18 includes a curved link member 36 which is disposed inside the cylinder 14 and spans the lower corner portions 12a and 12b of each two adjacent panels 12. Two holes 38 and 40 are formed through each lower panel corner 12a and 12b, and extend completely through the panel 12 as well as the band segments 24 and 26. The end portions of each link member 36 are formed with holes 42 and 44 which are aligned with or conjugate to the holes 38 and 40. Two identical pins 46 and 48 are inserted from inside the cylinder 14 and extend through the respective holes 38, 42 and 40, 44. The pins 46 and 48 have heads 46a and 48a which abut against the inner surface of the link member 36 and retaining end portions 46b and 48b which protrude through the outer band segments 26. Each link assembly 18 also includes a wedge 50 which retainingly engages in circumferential grooves 46c and 48c formed in the end portions 46b and 48b of the pins 46 and 48. A detailed view of the pin 46 is provided in FIG. 6.

Figure 6:
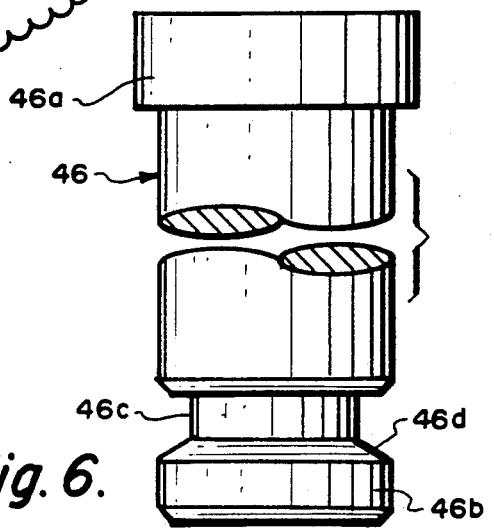
FIG. 6 is a plan view of a pin of the link assembly.
Figure 7:
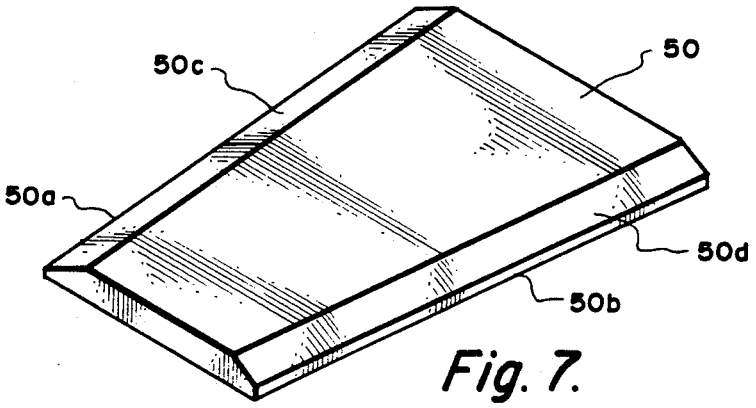
FIG. 7 is a perspective view of a wedge of the link assembly.

The wedged 50 have angled side edges 50a and 50b which engage in the circumferential grooves 48c and 46c of the pins 48 and 46 respectively when forced in therebetween from above. The holes 38 to 44 through the panels 12 and link members 36 are preferably made slightly larger in diameter than the pins 46 and 48 to prevent binding of the pins therein after prolonged operation of the furnace. The angled side edges 50a and 50b of the wedge 50 force the pins 46 and 48 away from each into tight abutting engagement with the opposite walls of the holes 38 to 44, thereby tightly retaining the panels 12, link member 36 and pins 46 and 48 against relative movement. As illustrated in FIG. 7, the side edges 50a and 50b of the wedge 50 are further formed with bevels 50c and 50d which face outwardly from the cylinder 14. The bevel 50d engages with an inclined wall 46d of the circumferential groove 46c in the pin 46 as shown in FIG. 6, thereby urging the pin 46 away from the center of the cylinder 14. This causes the head 46a of the pin 46 to abut against the inner surface of the link member 36, and thereby tightly retain the link member 36, panel 12, and pin 46 against relative movement. The bevel 50c of the wedge 50 engages with a similar inclined wall in the circumferential groove 48c of the pin 48, although not shown in the drawing.

The angled edges 50*a* and 50*b* of the wedge 50 lock the pins 46 and 48 of the link assembly 18 in the circumferential direction relative to the cylinder 14, whereas the bevels 50*c* and 50*d* lock the pins 46 and 48 in the radial direction.

The hanging heating element 10 is assembled by individually attaching the panels 12 to a supporting upper frame (not shown) by means of the electrical connectors 16, and interconnecting the lower corners 12*a* and 12*b* by means of the link assemblies 18. Each link member 36 is held in place behind the corner portions 12*a* and 12*b*, the pins 46 and 48 inserted from inside the panels 12, and the wedges 50 forced into tight retaining engagement in the grooves 46*c* and 48*c* of the pins 46 and 48 to mechanically and electrically interconnect the adjacent panels 12. The procedure is reversed for removing an individual panel 12 or the entire heating element 10.

Although not shown, special tools are preferably provided to assemble and disassemble the link assemblies 18 without applying forces thereto which would damage the panels 12. A suitable assembly tool would apply opposing vertical forces to the bottoms of the retaining end portions 46*b* and 48*b* of the pins 46 and 48, and the upper edge of the wedge 50, forcing the wedge 50 downwardly between the pins 46 and 48. A suitable disassembly tool would apply opposing horizontal forces to the outer sides of the retaining end portions 46*b* and 48*b* of the pins 46 and 48, urging the pins 46 and 48 toward each other. The angles of the edges 50*a* and 50*b* are selected such that the wedge 50, in response to the thusly applied pinching force from the pins 46 and 48, will be popped upwardly out of the grooves 46*c* and 48*c* of the pins 46 and 48, and can be removed easily by hand, together with the pins 46 and 48 and link member 36. In both assembly and disassembly of the link assemblies 18, no forces in the radial direction of the cylinder 14 are applied which might cause damage to the panels 12.

While an illustrative embodiment of the invention has been shown and described, numerous variations and alternate embodiments will occur to those skilled in the art, without departing from the spirit and scope of the invention. For example, two adjacent, rather than two diametrically opposed panels may be connected to two respective electrical phases of opposite polarities. This would enable the provision of three individual assemblies, each consisting of two adjacent panels. Accordingly, it is intended that within the scope of the appended claims, the present invention may be practiced otherwise than as specifically described.

We claim:

1. A hanging furnace heating element, comprising:

a multiple of six hanging electrical heater panels which are combined to form a vertical hollow cylinder, each panel having an electrical connector at an upper end thereof; and the same multiple of six electrically conductive removable link means interconnecting lower corner portions of each two adjacent panels repectively, with electrical power source means connected to apply six phases of alternating current to said electrical connectors in such a manner that phases having opposite polarities are applied to diametrically opposed panels respectively.

2. A heating element as in claim 1, in which the panels have a curvature equal to a radius of said cylinder.

3. A heating element as in claim 1, in which the removable link means are fusible at a lower electrical current than the panels.

4. A heating element as in claim 1, in which each removable link means is mechanically weak enough to break before said two panels to which it is connected in response to relative movement between said two panels.

5. A heating element as in claim 1, in which each removable link means comprises an elongated link member disposed inside the cylinder which spans the corner portions of said two adjacent panels to which it is connected and pins which retainingly extend through conjugate holes formed through the link member and the corner portions respectively.

6. A heating element as in claim 1, in which each of the corner portions of the panels is formed with two holes therethrough, each removable link means comprising:

an elongated link member disposed inside the cylinder which spans the corner portions of said two adjacent panels to which it is connected, and is formed with two holes at each end portion thereof which are conjugate to the two holes formed through the respective corner portions;

four pins which extend through said four holes of the link member and the conjugate four holes of the corner portions respectively, each pin having a head which abuts against the link member and a retaining portion which protrudes through the respective panel; and two retaining means, each of which retainingly engages with the retaining portions of the two pins at each respective end portion of the link member.

7. A heating element as in claim 6, in which each retaining means comprises a wedge member having angled side edges which engage with the retaining portions of the respective pins.

8. A heating element as in claim 7, in which the retaining portion of each pin is formed with a circumferential groove, the side edges of the wedge members retainingly engaging in the respective circumferential grooves.

9. A heating element as in claim 8, in which the angled side edges of the wedge members are formed with bevels which face outwardly from the cylinder and engage with the circumferential grooves to urge the pins outwardly such that the heads of the pins retainingly abut against the respective link members.

10. A heating element as in claim 9, in which a diameter of the holes is slightly larger a diameter of the pins, the wedge members urging each respective two pins away from each other into abutting engagement with opposite walls of the holes.

* * * * *